US007772990B2

(12) United States Patent
Evans

(10) Patent No.: US 7,772,990 B2
(45) Date of Patent: Aug. 10, 2010

(54) SIGNAL MONITOR WITH PROGRAMMABLE NON-CRITICAL ALARM

(75) Inventor: Scott Richard Evans, Gilbert, AZ (US)

(73) Assignee: Eberle Design, Inc., Phoenix, AZ (US)

( * ) Notice: Subject to any disclaimer, the term of this patent is extended or adjusted under 35 U.S.C. 154(b) by 252 days.

(21) Appl. No.: 11/770,429

(22) Filed: Jun. 28, 2007

(65) Prior Publication Data

US 2009/0002194 A1 Jan. 1, 2009

(51) Int. Cl.
*G08G 1/097* (2006.01)

(52) U.S. Cl. ..... 340/931; 340/642; 701/117

(58) Field of Classification Search ..... 340/931, 340/642; 701/117
See application file for complete search history.

(56) References Cited

U.S. PATENT DOCUMENTS 3,902,156 A * 8/1975 Hill ..... 340/931
4,734,862 A * 3/1988 Marcus et al. ..... 701/117

* cited by examiner

*Primary Examiner*—Daryl Pope
(74) *Attorney, Agent, or Firm*—Ingrassia Fisher & Lorenz, P.C.

(57) ABSTRACT

A signal monitor includes an alarm function module configured to compare a plurality of input signals associated with traffic control to a set of programmable criteria associated with predetermined events, and to produce a non-critical alarm signal when at least one of the set of programmable criteria is satisfied. This non-critical alarm signal—which is associated with programmable alarm conditions that do not require that the intersection enter the "flash" mode—is communicated to the controller, which may then log and/or transmit the non-critical alarm condition to a central station or maintenance point.

13 Claims, 3 Drawing Sheets

SIGNAL MONITOR WITH PROGRAMMABLE NON-CRITICAL ALARM

TECHNICAL FIELD

The present invention generally relates to traffic control devices and, more particularly, to signal monitors configured to transmit one or more alarm states to a controller.

BACKGROUND

A signal monitor is a device used in traffic control assemblies to detect and respond to conflicting or otherwise improper signals. Such improper signals may arise, for example, due to field signal conflicts, a malfunctioning controller, faulty load switches, cabinet mis-wiring, improper supply voltages, and the like.

When one or more certain critical failures occur, the signal monitor instructs (or causes other components to instruct) the signal lights to enter an emergency "flash" mode, in which the traffic lights on all sides of the intersection generally enter a flashing red state.

It is often the case that certain other events external or internal to the traffic control cabinet occur that should be attended to, but which do not typically require the intersection to enter the flash mode. Such events include, for example, damage to the controller cabinet, problems with the cabinet power supplies, data communications issues, and relatively non-critical signal light conditions (such as faulty "DON'T WALK" signals, minimum green time violations, etc.) Some prior art signal monitors include additional logic outputs that provide more detailed status information to the controller, but such information is only provided in cases where a critical fault has occurred, and the intersection is already in a flash mode.

It is therefore desirable to provide improved signal monitor systems that may be programmed to identify non-critical events and communicate appropriate alarms to the controller based on those events. Furthermore, other desirable features and characteristics of the present invention will become apparent from the subsequent detailed description of the invention and the appended claims, taken in conjunction with the accompanying drawings and this background of the invention.

SUMMARY OF THE INVENTION

The present invention relates to a signal monitor comprising an alarm function module configured to compare a plurality of input signals to a set of programmable criteria associated with predetermined events, and to produce a non-critical alarm signal when at least one of the set of programmable criteria is satisfied. This non-critical alarm signal—which is associated with programmable alarm conditions that do not require that the intersection enter the "flash" mode—is communicated to the controller, which may then log and/or transmit the non-critical alarm condition to a central station or maintenance point.

BRIEF DESCRIPTION OF THE DRAWINGS

A more complete understanding of the present invention may be derived by referring to the detailed description when considered in connection with the Figures, where like reference numbers refer to similar elements throughout the Figures, and.

DETAILED DESCRIPTION

Figure 1:
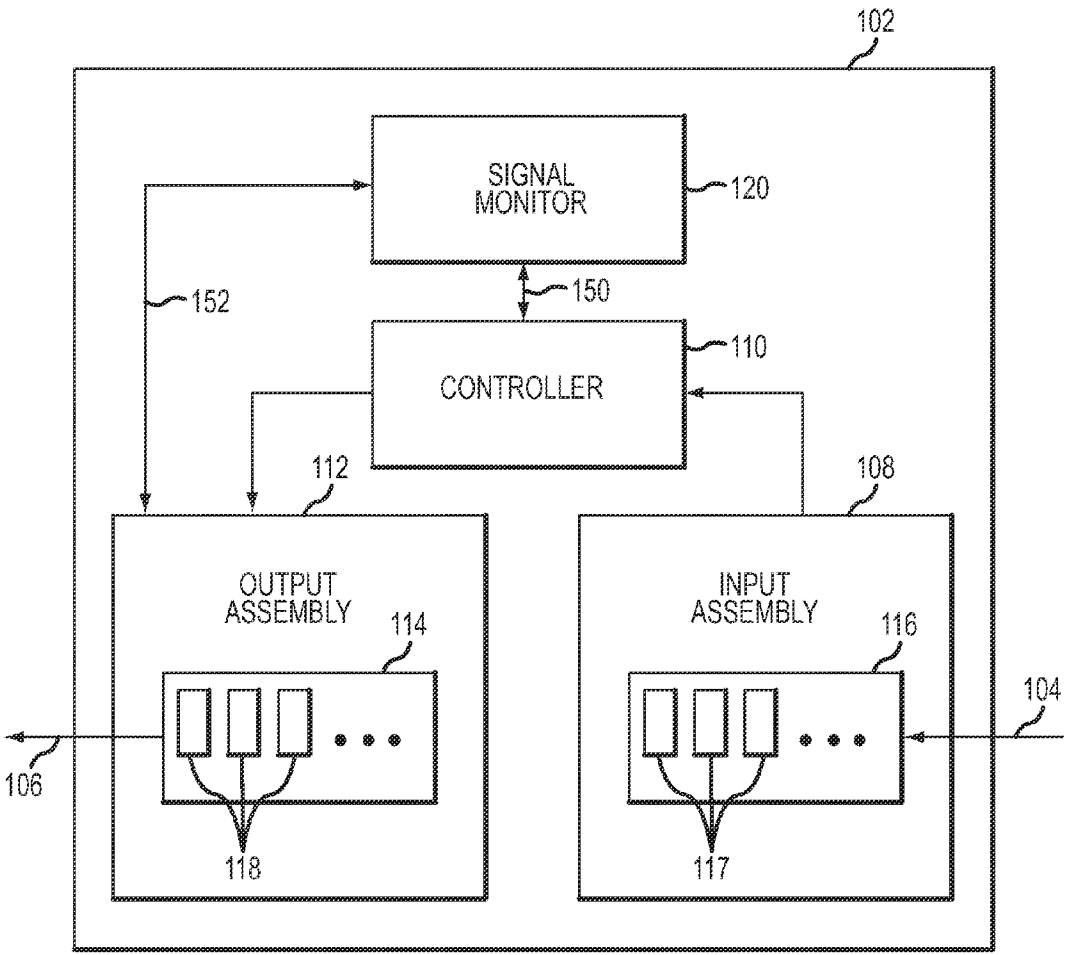
FIG. 1 is a schematic overview depicting the components of a typical traffic control cabinet in which the present invention may be deployed.

The following detailed description is merely exemplary in nature and is not intended to limit the range of possible embodiments and applications. Furthermore, there is no intention to be bound by any theory presented in the preceding background or the following detailed description.

For simplicity and clarity of illustration, the drawing figures depict the general topology, structure and/or manner of construction of the various embodiments. Descriptions and details of well-known features and techniques may be omitted to avoid unnecessarily obscuring other features. For example, conventional techniques and components related to traffic control devices are not described in detail herein. Elements in the drawings figures are not necessarily drawn to scale: the dimensions of some features may be exaggerated relative to other elements to assist improve understanding of the example embodiments.

Terms of enumeration such as "first," "second," "third," and the like may be used for distinguishing between similar elements and not necessarily for describing a particular spatial or chronological order. These terms, so used, are interchangeable under appropriate circumstances. The embodiments of the invention described herein are, for example, capable of use in sequences other than those illustrated or otherwise described herein. Unless expressly stated otherwise, "connected," if used herein, means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically.

The terms "comprise," "include," "have" and any variations thereof are used synonymously to denote non-exclusive inclusion. The terms "left," "right," "in," "out," "front," "back," "up," "down," and other such directional terms are used to describe relative positions, not necessarily absolute positions in space. The term "exemplary" is used in the sense of "example," rather than "ideal."

Referring to FIG. 1, a typical intersection cabinet (or simply "cabinet") 102 useful in describing the present invention generally contains an input assembly 108, an output assembly 112, a controller 110, and a signal monitor 120. Controller 110 is coupled to output assembly 112 and input assembly 108, as well signal monitor 120. Those skilled in the art will appreciate that such cabinets vary greatly with respect to both design and components.

Signal monitor 120 is a device used in traffic controller assemblies and other applications to detect and respond to conflicting or otherwise improper signals caused by a malfunctioning controller, faulty load switches, cabinet mis-wiring, improper supply voltages, or other such failure mechanisms. Signal monitor units are typically configured as a 16-channel monitor, but may also have 32 channels, 12 channels, 6 channels, or any other number of channels. The term "signal monitor" is used to encompass any of the variety of related components whose names may vary depending upon manufacturer, such as "malfunction management units," "conflict monitor units," and the like.

The general functional requirements of conventional signal monitor units are well-known, and are covered by a variety of standards, including, for example, National Electrical Manufacturers Association (NEMA) TS2-2003, Traffic Controller Assemblies with NTCIP Requirements, v02.06, NEMA TS1-1989 (rev. 2000), Traffic Control Systems, AASHTO/ITE/NEMA Intelligent Transportation Systems (ITS) Standard Specification for Roadside Cabinets, v 01.03, Caltrans Transportation Electrical Equipment Specifications (TEES), August 2002. In this regard, signal monitors are often referred to in terms of which standards they conform to, including, for example, NEMA TS-2 signal monitors, NEMA TS-1 signal monitors, 2010 signal monitors, 210 signal monitors, ITS signal monitors, etc. It will be appreciated that the present invention is not limited to any of these particular standards or types of signal monitors.

Referring again to FIG. 1, input assembly 108 typically includes an array 116 of input devices (such as vehicle detectors 117) which receive input signals 104 from the intersection environment through imbedded inductive loops and other such sensors. Similarly, output assembly 112 typically includes a set 114 of output devices (such as load switches 118) which communicate with the environment via output 106 to effect traffic control via activation of the appropriate traffic signals. To do so, controller 110 communicates with and controls the various assemblies within cabinet 102. The present invention is not limited, however, to specific controller units or communication protocols.

Signal monitor 120 may be configured such that it receives and processes signals not only from output assembly 112, but also controller 110. In this way, signal monitor 120 provides "field checking." That is, signal monitor 120 is capable of determining the output of load switches 118 while at the same time monitoring what controller 110 has instructed those outputs to be.

In conventional signal monitor designs, when one or more critical failures occur, the signal monitor instructs (or, more generally, causes other components to instruct) the signal lights to enter an emergency "flash" mode, in which the traffic lights on all sides of the intersection generally enter a flashing red state. More particularly, a flash transfer relay (not illustrated) within output assembly 112 is typically instructed directly by signal monitor 120 to enter the flash mode. The nature of such flash modes, transfer relays, and load switches are known in the art, and need not be described in detail herein.

Figure 2:
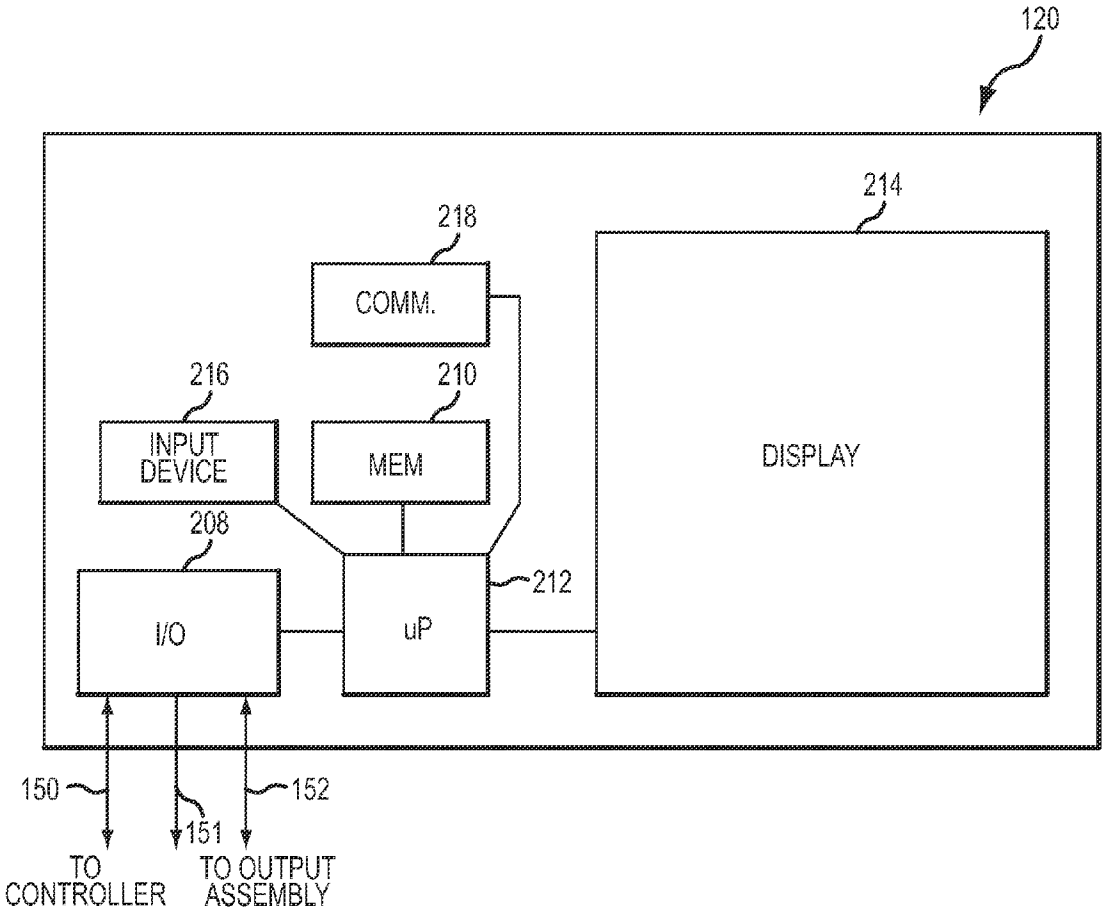
FIG. 2 is a schematic block diagram of a signal monitor in accordance with one embodiment.

FIG. 2 is a simplified block diagram of a signal monitor 120 in accordance with the present invention, which generally includes a display 214, a memory 210 (e.g., RAM, ROM, EEPROM, or combination thereof), a microprocessor or microcontroller 212, input/output (I/O) circuitry (or simply "I/O") 208, a user communication port 218, and one or more input devices (e.g., keypads, keyboards, mice, touchpads, etc.) 216. It will be understood that numerous other electronic components will typically be present in such a system, but have been removed for the purpose of clarity.

Display 214 of signal monitor 120 comprises one or more display components capable of displaying information pertinent to the operation of the system as described herein. In this regard, display 214 may include one or more displays of any type now known or developed in the future, including without limitation liquid crystal displays (LCDs), light emitting diode (LED) displays, electroluminescent displays, and the like. Similarly, such displays might be general-purpose, pixel-based displays or custom displays with dedicated display components ("icon-based"), or a combination thereof.

Display 214 is preferably interactive (or "navigable") in that its displayed content is responsive to input device 216—e.g., one or more buttons, touch screen signals, or any form of direct or indirect input. In this regard, the present invention is not limited to any particular size, shape, geometry, or configuration of inputs and outputs. Furthermore, the present invention may be implemented in a device that does not include a display or input device, provided that some form of external user interface is provided for programming the operable features of the signal monitor.

I/O 208 communicates via line 150 with controller 110 (not shown in FIG. 2), and communicates via line 152 with the various load switches in the output assembly (i.e., the "field"). Furthermore, a line 151 provides an output signal to the flash control circuitry (not shown). The operation of conventional flash control outputs and load switches is well known in the art, and need not be described herein. Line 150 is shown as a single communication channel, but it will be understood that it may include multiple lines and communication channels configured to interface with one or more inputs and outputs on the controller unit. The nature of the physical interface between controller 110 and signal monitor 120 will vary depending upon the specific hardware and applicable standards being used.

Communication port 218 may be provided to allow, for example, the user to upload various criterion as described in further detail below. This port may implement any suitable protocol and may include any convenient connector technology as is known in the art.

As mentioned previously, in accordance with conventional signal monitor operation, signal 151 is used, in part, to instruct the flash transfer relay(s) to place the traffic intersection into an emergency mode (e.g., via flashing red intersection signals) in the event that a "critical" fault has occurred. In accordance with the present invention, and as described in further detail below, signal monitor 120 is further capable of communicating the occurrence of a non-critical alarm event selected from a set of such programmed events.

Figure 3:
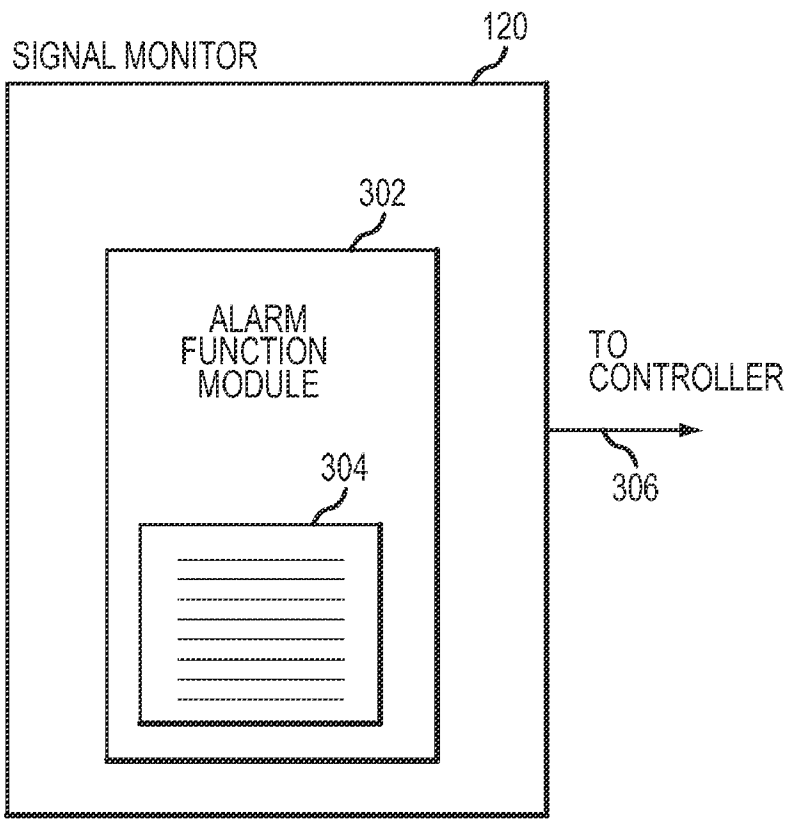
FIG. 3 is a conceptual block diagram of a signal monitor in accordance with another embodiment.

Referring to the conceptual block diagram shown in FIG. 3, a programmable alarm function module 302 ("alarm function module" or simply "alarm function") is implemented in signal monitor 120 via any suitable combination of hardware and/or software—for example, via microprocessor 212 operating in conjunction with software stored in memory 210 as shown in FIG. 2.

In this embodiment, a dedicated output line 306 is used to communicate the occurrence of a non-critical alarm event. As used herein, "non-critical alarm event" refers to any event or state (either external or internal to the cabinet) that does not require the intersection entering "flash" mode, but needs attention or is preferably logged external to the monitor.

Output line 306 may take any form, from a single wire communicating a binary TRUE or FALSE state or a serial data packet, or any communication line now known or later developed. In a further embodiment, the receipt of a non-critical alarm signal may be communicated to a central station or other maintenance point through any suitable data communication method. This may be the result of the controller's response to the alarm input, or output 306 may be directly connected to a device other than controller 110—e.g., a radio, signal beacon, or the like.

Figure 4:
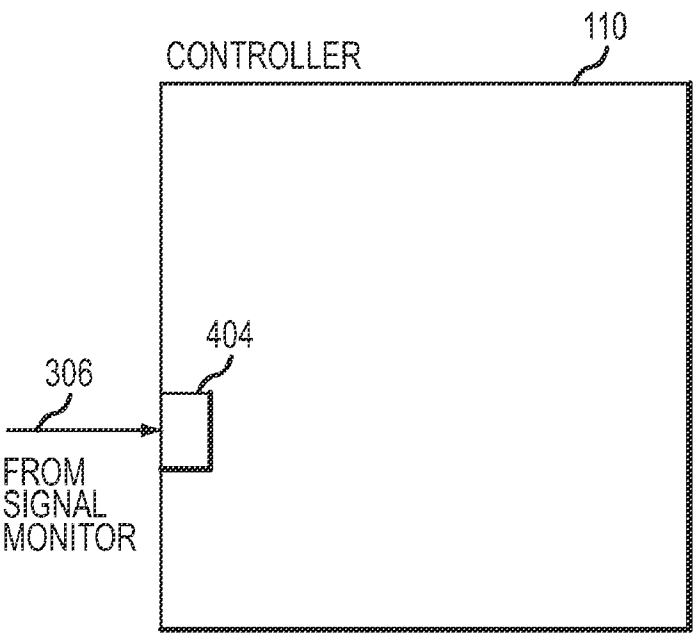
FIG. 4 is a conceptual block diagram of a controller configured to operate with a signal monitor of the present invention.

Alarm function 302 includes a set of criterion 304 associated with the programmed non-critical alarm events. During normal operation of the cabinet shown in FIG. 1, signal monitor 120 continually or periodically examines the state of the system and field components. If one or more of criterion 304 are met, a suitable signal is communicated to the controller via line 306, and controller 110 acts accordingly. As shown in FIG. 4, controller 110 may, depending upon the type of controller used and the specification being implemented, include a dedicated "Alarm" or "Special Status" input 404, which is configured to be coupled to line 306 from signal monitor 120. See, for example, the TS-2-2003 specification referenced above.

The set of criteria 304 is configured to include a variety of events that warrant an alarm, but which do not require forcing the intersection into "flash" mode. Categories of such events include, for example, damage to the controller cabinet, problems with the cabinet power supplies, data communications issues, and non-dangerous signal light conditions. More particularly, criteria 304 may include, for example: whether a "Don't Walk" signal has failed ON or failed OFF; whether a minimum green time violation has occurred (i.e., whether the intersection has cycled through the Green signal faster than a predetermined minimum time); whether the minimum pedestrian clearance time has violated; whether the cabinet has been hit and/or has been moved or rotated out of its proper position (as determined by an accelerometer or other sensor); whether a problem with the AC power line exists (e.g., overvoltage or improper frequency); and/or whether there has been communication loss between the various subsystems within the cabinet or external to the cabinet.

In a further embodiment, certain events that would typically lead to a "flash" condition are redefined as non-critical faults and included in the set of criterion 304. Such an event may include, for example, the NEMA TS-2 port 1 Fail condition.

Criterion 304 may be programmed into the unit through any suitable means—e.g., via input device 216 and display 214 as shown in FIG. 2. For example, programming may be accomplished from a front panel menu-driven interface, wherein the user is presented with a predetermined list of event types that can be enabled by the user. A software "wizard" may be implemented to assist the user. Each event type may have parameters associated therewith, such as channels, voltages, timing, etc. The criterion might also be developed in a scripting language or created on a separate computing device and uploaded to the monitor through a suitable port (e.g., communication port 218).

Other advantages and structural details of the invention will be apparent from the attached figures, which will be well understood by those skilled in the art. The present invention has been described above with respect to a particular exemplary embodiment. However, many changes, combinations and modifications may be made to the exemplary embodiments without departing from the scope of the present invention.

The invention claimed is:

1. A signal monitor of the type configured to accept a plurality of input signals associated with traffic control at an intersection, the signal monitor comprising an alarm function module configured to compare the plurality of input signals to a set of programmable criteria associated with predetermined events, and to produce a non-critical alarm signal when at least one of the set of programmable criteria is satisfied, wherein the non-critical alarm signal does not correspond to a set of alarm signals requiring that the traffic control at the intersection enter a flash mode.

2. The signal monitor of claim 1, further including an input device configured to allow a user to specify the set of programmable criteria.

3. The signal monitor of claim 2, further including a display configured to display the set of programmable criteria.

4. The signal monitor of claim 1, wherein the signal monitor includes a dedicated output line for communicating the non-critical alarm signal to a controller.

5. A traffic control system comprising:

a signal monitor configured to accept a plurality of input signals associated with traffic control at an intersection, the signal monitor comprising an alarm function module configured to compare the plurality of input signals to a set of programmable criteria associated with predetermined events, and to produce a non-critical alarm signal when at least one of the programmable criteria is satisfied, wherein the non-critical alarm signal does not correspond to a set of alarm signals requiring that the traffic control at the intersection enter a flash mode;

a controller coupled to the signal monitor, the controller configured to receive the non-critical alarm signal.

6. The system of claim 5, wherein the controller is configured to receive the non-critical alarm signal via a dedicated line.

7. The system of claim 6, wherein the dedicated line corresponds to a special status input.

8. The system of claim 5, wherein the signal monitor including an input device configured to allow a user to specify the set of programmable criteria.

9. The system of claim 5, wherein the controller is further configured to transmit the non-critical alarm signal to a maintenance point.

10. A signal monitoring method comprising:

providing a set of criteria associated with predetermined non-critical events, wherein the non-critical events do not require that an intersection enter a flash mode;

accepting a plurality of input signals associated with traffic control at an intersection, comparing the plurality of input signals to a set of programmable criteria associated with the predetermined non-critical events; and producing a non-critical alarm signal when at least one of the set of criteria is satisfied.

11. The method of claim 10, further including transmitting the non-critical alarm signal to a controller over a dedicated line.

12. A computer-readable medium having program code embodied therein for causing a signal monitor to perform the steps of:

accepting a plurality of input signals associated with traffic control at an intersection, comparing the plurality of input signals to a set of programmable criteria associated with predetermined non-critical events, wherein the non-critical alarm signal does not correspond to a set of alarm signals requiring that the traffic control at the intersection enter a flash mode; and producing a non-critical alarm signal when at least one of the set of programmable criteria is satisfied.

13. The computer-readable medium of claim 12, further including providing a user interface configured to allow a user to specify the programmable criteria.

* * * * *